United States Patent [19]

Friedericy et al.

[11] 4,253,520

[45] Mar. 3, 1981

[54] HEAT EXCHANGER CONSTRUCTION

[75] Inventors: Johan A. Friedericy, Palos Verdes Estates; Gary F. Mueller, Huntington Beach; James R. Lohay, Santa Ana, all of Calif.

[73] Assignee: The Garrett Corporation, Los Angeles, Calif.

[21] Appl. No.: 955,284

[22] Filed: Oct. 26, 1978

[51] Int. Cl.[3] ..... F28F 3/00

[52] U.S. Cl. ..... 165/166; 29/157.3 D; 165/134 R

[58] Field of Search ..... 165/134, 166, DIG. 4, 165/55, 81, 146, 149, 181, 183; 29/157.3 D

[56] References Cited

U.S. PATENT DOCUMENTS

| | | |
|---|---|---|
| 370,865 | 10/1887 | Hague et al. . |
| 1,782,829 | 11/1930 | Nash, et al. . |
| 1,879,140 | 9/1932 | Edwards . |
| 2,093,686 | 9/1937 | Murray, Jr. . |
| 2,197,006 | 4/1940 | Peters et al. . |
| 2,995,871 | 8/1961 | Schuchert . |
| 3,149,667 | 9/1964 | Astrup . |
| 3,150,714 | 9/1964 | Jacobs et al. . |
| 3,586,100 | 6/1971 | Yasuda et al. . |
| 3,826,957 | 7/1974 | McLaughlin et al. . |
| 3,190,3652 | 6/1965 | Simplaar . |

FOREIGN PATENT DOCUMENTS

| | | |
|---|---|---|
| 1122080 | 9/1956 | Fed. Rep. of Germany . |
| 585192 | 10/1944 | United Kingdom . |

*Primary Examiner*—George T. Hall

*Attorney, Agent, or Firm*—Albert J. Miller; Joel D. Talcott; Joseph A. Yanny

[57] ABSTRACT

A plate-fin heat exchanger construction including peripheral channels each receiving a mass for protecting the plates against stress failure.

25 Claims, 6 Drawing Figures

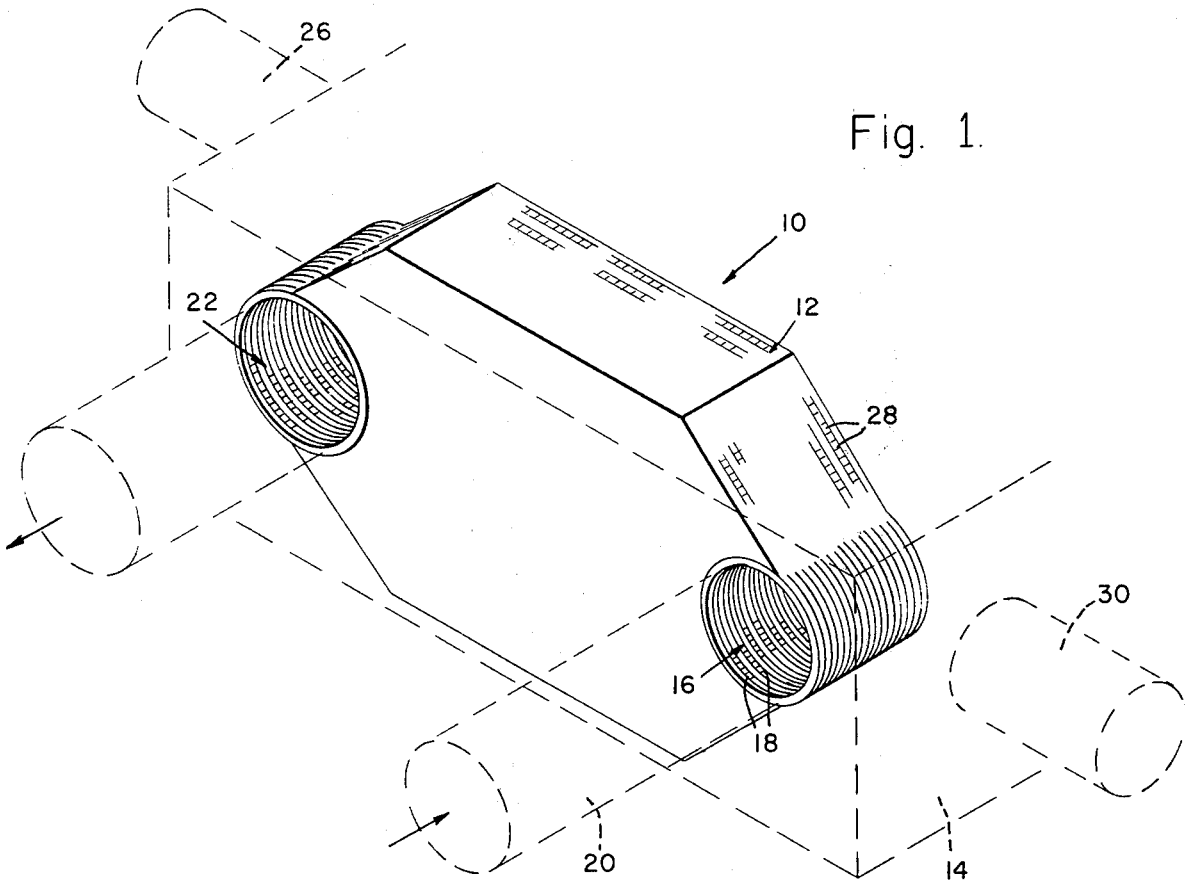
Fig. 1.
Fig. 2.
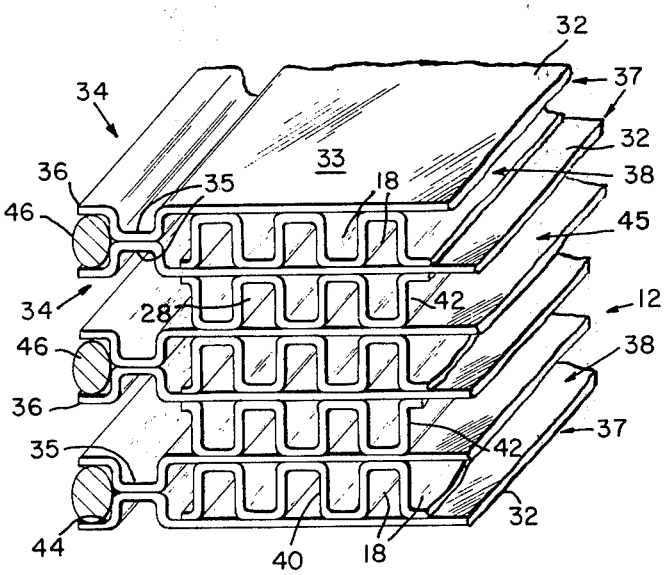

HEAT EXCHANGER CONSTRUCTION

BACKGROUND OF THE INVENTION

This invention relates to a heat exchanger construction. More specifically, this invention relates to a plate-fin heat exchanger core including means for strengthening the core and for protecting the peripheral edges thereof against thermal stress failure.

Heat exchangers in general are well known in the prior art, and typically comprise a heat exchanger core having dual fluid flow paths for passage of two fluids in heat exchange relation with each other without intermixing. The fluid flow paths commonly comprise a plurality of relatively small and/or intricately shaped passages formed within a heat exchanger core so as to maximize the available core surface area for absorbing and transferring heat from one fluid to another.

In the prior art, plate-fin heat exchangers have become popular largely because of their simplicity of fabrication and ease of assembly. Such plate-fin heat exchangers comprise a core formed by a stacked series of thin plates connected together in a spaced relationship so as to provide fluid flow regions between the plates. Extended surface fin elements are interposed between the plates to form a multiplicity of relatively small fluid flow paths within the flow regions, and to increase the available surface area for absorbing and transferring heat. Suitable manifolds supply the two fluids to the heat exchanger for flow through the flow paths in the core without intermixing.

A common problem with plate-fin heat exchangers comprises stress failure of the thin plates, particularly at their outer, peripheral edges. More specifically, the heat exchanger experiences substantial thermal gradients and stresses upon start-up and/or shut down, and these thermal gradients are particularly pronounced at the peripheral edges of the core. The thermal gradients result in substantial expansion or contraction of the thin core-forming plates which all too frequently causes the plates to crack or separate. Such cracking or separation of the plates allows undesirable leaking and intermixing of the fluids, and thereby shortens the useful life of the heat exchanger.

Another common problem with plate-fin heat exchangers comprises so-called creep failure of the relatively thin core-forming plates. That is, during sustained thermal loading at operating temperatures, the thin plates experience a relatively slight and random stretching and contracting known as creep. This slight creeping of the plates with respect to each other contributes to eventual cracking or separating of the plates, particularly at the peripheral plate edges.

Some prior art heat exchangers have included devices for protecting the peripheral edges of the plates in a plate-fin heat exchanger. In one arrangement, these protective devices have comprised outwardly projecting fins which are primarily intended to protect the plates against damage from erosion or contact with foreign objects. See, for example, British Pat. No. 585,192. Other protective devices have included plate-like shields for shielding the plates against high temperature radiant heat energy. See, for example, U.S. Pat. Nos. 370,865; 2,093,686; 3,150,714. Still other prior art techniques have involved the attachment of fin-like elements to designated areas exposed to high heat. See, for example, German Pat. No. 1,122,080. However, none of these prior art techniques satisfactorily resolve the problems of stress failures resulting primarily from the substantial thermal gradients experienced at the peripheral edges of a plate-fin heat exchanger.

The present invention overcomes the problems and disadvantages of the prior art by providing an improved heat exchanger construction including appropriately sized masses mounted at the peripheral edges of the core-forming plates in a plate-fin heat exchanger for controlling expansion and contraction of the plates so as to reduce stress failures.

SUMMARY OF THE INVENTION

In accordance with the invention, a plate-fin heat exchanger construction comprises a plurality of relatively thin plates having trough-shaped edges and connected together in inverted pairs to form central flow regions between the connected plates. A plurality of generally corrugated first fin elements are received within the central flow regions between the connected pairs of plates to form a first series of relatively small fluid flow passages, and the plate pairs are arranged in an alternating stack with a plurality of generally corrugated second fin elements forming a second series of relatively small fluid flow passages. Suitable manifolding is provided for directing flow of a first fluid through the first flow passages in heat exchange relation with a second fluid manifolded for flow through the second flow passages.

The trough-shaped edges of each connected pair of plates form a generally outwardly presented channel in which is embedded an elongated heat-absorbing strip of predetermined size and shape. In a preferred embodiment, the elongated strip comprises a thermal mass formed from a suitable heat absorbing and retaining material such as a metallic or ceramic wire, and is wrapped peripherally about the connected pair of plates. The strip absorbs and retains heat upon start-up and/or shutdown of the heat exchanger to smooth out and minimize thermal gradients at the peripheral plate edges.

In another embodiment of the invention, the strip is pretensioned prior to operation of the heat exchanger. In this manner, the core-forming plates are maintained under compression during operation of the heat exchanger to controllably limit thermal expansion of the plates, and thereby help to avoid stress failures. Alternately, the strip may be formed from a suitable material which is resistant to thermal creeping relative to the plates at normal heat exchanger operating temperatures, whereby the creep-resistant strip serves to controllably limit relative movement of the plates to protect the peripheral edges of the plates against creep failure.

BRIEF DESCRIPTION OF THE DRAWINGS

The accompanying drawings illustrate the invention. In such drawings:

FIG. 1 comprises a generally schematic illustration of a plate-fin heat exchanger construction;

FIG. 2 comprises an enlarged fragmented perspective view of a portion of a plate-fin heat exchanger illustrating one embodiment of the invention;

DETAILED DESCRIPTION OF THE PREFERRED EMBODIMENT

Figure 3:
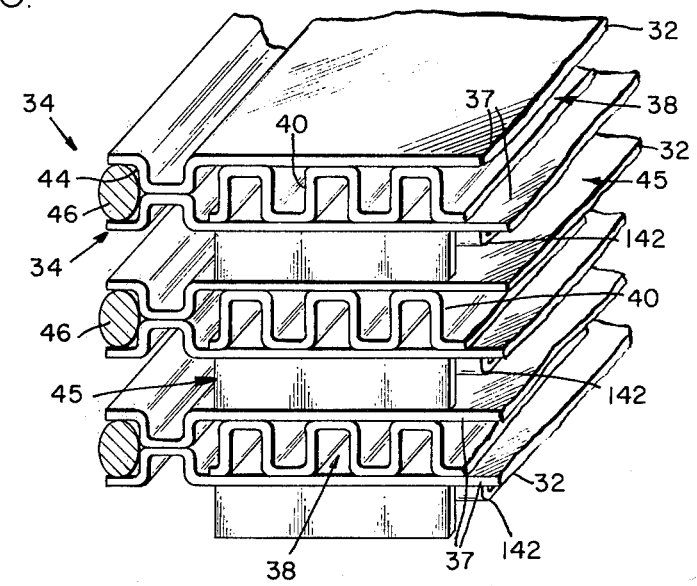
FIG. 3 comprises a fragmented perspected view of a portion of an alternate heat exchanger construction embodying the invention.

A heat exchanger 10 is shown generally in FIG. 1, and comprises a heat exchanger core 12 carried within a housing 14, with the housing and associated conduits being illustrated in dotted lines. As shown, the heat exchanger core 12 comprises a laminated stack of plate-fin elements formed from suitable metallic, ceramic, or similar materials, and forming two fluid flow paths for passage of two fluids in close heat exchange relation with each other. More specifically, one end of the core 12 is suitably formed to provide a cylindrical inlet manifold 16 communicating with a conduit 20 or the like for supplying flow of a first fluid such as air to one of the fluid flow paths. As shown, this first fluid flow path is formed by a plurality of relatively small flow passages 18 which direct the air through the core 12 of the heat exchanger to a cylindrical outlet manifold 22. The outlet manifold 22 is disposed at the opposite end of the core 12 from the inlet manifold 20, and communicates with a conduit 24 or the like for conducting the air collected in the outlet manifold 22 away from the heat exchanger.

A second fluid such as a heated gas is supplied to the interior of the heat exchanger housing 14 as by an inlet conduit member 26. The hot gas flows through a second fluid flow path comprising a plurality of relatively small flow passages 28 in the heat exchanger core 12. These second flow passages 28 cause the hot gas to flow in close heat exchange relation with the air circulating through the first passages 18 whereby the gas transfers a substantial amount of heat energy to the air prior to exiting the housing 14 as by an outlet conduit member 30. Thus, the hot gas is substantially cooled within the core of the heat exchanger 12.

An enlarged fragmented portion of the heat exchanger core 12 is shown in FIG. 2. As shown, the core 12 comprises a plurality of relatively thin plates 32 each having a generally planar central portion 33 bounded by a generally troughed or U-shaped peripheral edge 34. The trough-shaped edge 34 forms a recess or channel 35, and terminates in an outwardly extending lip or fin 36. To form the core 12, the plates 32 are connected in inverted pairs 37 with the trough-shaped edges 34 of each plate pair in abutting contact with each other and with the channels 35 in an aligned, back-to-back relation. In this configuration, the central portions 33 of each connected plate pair 37 are spaced substantially in parallel from each other to define an extended flow region 38 between the plates 32 comprising the connected pair 37. Moreover, as will be described in more detail, the peripheral edges 34 of the connected plates 37 including the outwardly extending fins 36 combine to form an outwardly presented peripheral recess 44.

Extended surface fin elements 40 are positioned within the flow regions 38 of each pair 37 of connected plates 32. These fin elements 40 have a generally corrugated and/or offset path configuration to form the plurality of relatively small fluid flow passages 18, and thereby comprise the fluid flow path for the circulating air. These flow passages 18 are adapted to communicate between the inlet air manifold 16 and the outlet air manifold 22, (FIG. 1) with the fin elements 40 providing substantial heat transfer surface area along the lengths of these passages 18.

The plates 32 connected in pairs 37 and including the fin elements 40 are arranged in an alternating stack with a second plurality of extended surface fin elements 42 to form the assembled heat exchanger core 12. More specifically, as shown in FIG. 2, the core is formed by interposing one of the second fin elements 42 between connected pairs 37 of the plates 32 so as to provide an extended flow region 45 generally parallel with and between adjacent flow regions 38. The second fin elements 42 are substantially similar to the first fin elements 40, including a generally corrugated configuration. The second fin elements 42 thus form the plurality of relatively small fluid flow passages 28 comprising the flow path for the heated gas. Accordingly, the two fluids flowing through the core 12 pass in close heat exchange relation with each other, with the fin elements 40 and 42 providing substantial heat transfer surface area.

The heat exchanger core 12 is assembled by connecting together the plates 32 in pairs 37, and the fin elements 40 and 42 into the stacked or laminated arrangement described above and shown in FIG. 2. In practice, the components may be connected together by a variety of techniques, such as welding, brazing, or the like. However, in a preferred embodiment, the components are connected together by brazing, with a sealed braze joint being provided between the aligned channels 35 of the peripheral trough-shaped edges 34 of each connected pair 37 of plates 32. In this manner, the flow regions 38 formed by the connected pairs 37 of plates 32 form air flow paths which are isolated from the gas flow paths defined by the flow regions 45, whereby the two fluids pass in close heat exchange relation without intermixing.

An elongated strip 46 of predetermined size and shape is received within the outwardly presented recess 44 of each pair 37 of connected plates 32. The strips 46 each comprise an elongated element of suitable thermal mass properties for absorbing and retaining heat energy to protect the peripheral edges 34 of the plates 32 against crackage due to stress failure. That is, upon start-up and/or shut down of the heat exchanger, the thermal strips 46 comprise heat sinks serving to absorb heat energy to smooth out and minimize expansion effects due to thermal gradients.

Each strip 46 is formed from a suitable metal or ceramic strip, wire, or the like, and is embedded within the associated recess 44. Each strip 46 is wrapped completely about its associated pair 37 of plates 32 to completely occupy the recess 44, and thereby also physically strengthen the plates 32. The strips 46 may be secured in position as by brazing upon formation of the heat exchanger, or they may be secured in position after the heat exchanger is assembled. The precise physical characteristics of the strips 46 such as size mass, etc., will vary according to the composition and operating environment of the plates 32 of the heat exchanger core 12. The selection of suitable strips 46 for a given heat exchanger is believed to be within the skill of the art, and accordingly is not described in detail.

Each strip 46 may be adapted for placing the associated pair 37 of plates 32 under compression to further strengthen the heat exchanger core. Specifically, each strip 46 may be tensioned so as to place the associated plates 32 under continuous peripherally inward compression. Such peripheral compression serves to limit expansion of the plates upon start-up, and thereby also helps to reduce stress failures. Placing the plates under compression also allows the plates to withstand relatively greater fluid pressures so as to prolong core life, or to allow the use of relatively lightweight or low strength plates in high pressure fluid applications.

The strips 46 may be chosen from a material having suitable thermal properties so as to yield the desired combined thermal mass and/or stressing effect on the plates 32. For example, the strips 46 may be chosen to have a coefficient of thermal expansion which is less than the coefficient of thermal expansion of the plates 46. Thus, as the heat exchanger temperature increases upon start-up, the strips 46 expand less than the plates 32 so as to place the plates 32 under peripheral compression during operation. Alternately, the strips 46 may be chosen from a material having a higher coefficient of thermal expansion than that of the plates 32. In this example, the strips 46 may be mounted on the plates 32 during brazing at elevated temperatures of the heat exchanger core during assembly. During cool-down, the strips 46 will attempt to shrink more rapidly than the plates 32, but will be prevented from normal shrinkage as they become secured in solidifying braze alloy material whereby the strips 46 will effectively become pretensioned to place the plates 32 under peripheral compression. Conversely, the use in the preceding example of strips 46 having a lower coefficient of thermal expansion than the plates will function to place the plates under peripheral tension which may be required in some heat exchanger applications. Still further, if desired, the strips 46 may be pretensioned to place the plates 32 under compression as by mechanical means such as stakes, turnbuckles, crimps, and the like.

The strips 46 may also be chosen from a suitable material which is relatively resistant to creeping when compared with the plates under sustained thermal loads. That is, during prolonged operation of a heat exchanger at elevated operating temperatures, the materials tend to experience a relatively random expansion and contraction phenomena known as creep. Selecting the strips 46 from a material which is more creep-resistant than the plates 32 tends to strengthen the plates against stress failures due to creep, and thereby prolong heat exchanger operating life.

While the embodiment of FIG. 2 illustrates the invention in a counter flow heat exchanger application, the invention may be adapted for use in a cross flow heat exchanger as shown in FIG. 3. That is, plates 32 including the trough-shaped peripheral edges 34 may be connected in pairs 37 to form the flow regions 38 receiving the first fin elements 40. The connected pairs 37 of plates 32 are arranged in an alternating stack with second fin elements 142 forming the fluid flow regions 45. As shown, the fin elements 142 define a plurality of relatively small flow passages 128 for passage of a fluid at a right angle to the passage of fluid through the flow regions 38. Against, as in the previous embodiment, the trough-shaped edges 34 include elongated strips 46 of predetermined size and shape received within the peripheral recesses 44 for protecting the plate edges 34 against stress failure. These masses 46 may be suitably adapted as described above with respect to the previous embodiment to further strengthen the heat exchanger core by placing the plates 32 under compression, or to reduce the occurrence of creep failures, etc.

Figure 4:
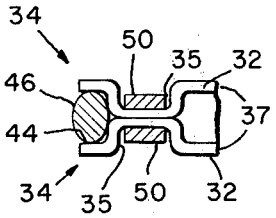
FIG. 4 comprises an enlarged fragmented section of a portion of a plate-fin heat exchanger construction showing another alternate embodiment of the invention.
Figure 5:
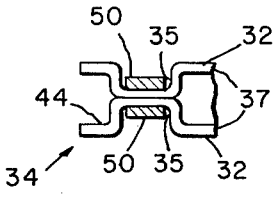
FIG. 5 comprises an enlarged fragmented section of a portion of a plate-fin heat exchanger construction showing still another alternate embodiment of the invention.

An enlarged fragmented portion of the connected peripheral edges 34 of another alternate plate-fin heat exchanger construction is shown in FIG. 4, and illustrates a further modification of the invention. As shown, the connected plates 32 include the trough-shaped peripheral edges 34 forming back-to-back channels 35 and the outwardly presented recess 44. An elongated strip 46 comprising a suitable thermal mass is received within the recess 44, and may be adapted as described above to place the plates 32 under compression, etc. The peripheral edges 34 are further strengthened by additional elongated strips 50 received within the back-to-back channels 35. These strips 50 are also formed from a preselected metallic or ceramic material having suitable thermal mass and/or creep resistant properties for controlling thermal gradients and relative movements at the edges 34, and may be used further to place the plates 32 under compression. Alternately, as illustrated in FIG. 5, these thermal mass strips 50 may be used separately from the thermal mass strips 46 of FIGS. 1–4, if desired, for protecting the plate edges 34 against stress failure.

Figure 6:
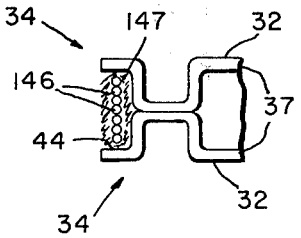
FIG. 6 comprises an enlarged fragmented section of a portion of a plate-fin heat exchanger construction illustrating another alternate embodiment of the invention.

Still another arrangement of the invention is shown in FIG. 6. As shown, a pair 37 of plates 32 for the heat exchanger core includes the trough-shaped peripheral edges 34 forming the outwardly presented peripheral recess 44. A plurality of elongated strips 146 are received within the recess 44 and these strips 146 comprise a plurality of wraps of a suitable wire-like material. The plurality of strips 146 form a thermal mass of predetermined size, shape and thermal properties to absorb and retain heat energy to protect the plates 32 against stress failure. Importantly, these strips 146 are circumferentially wrapped about the plates 32 and may be pretensioned to place the plates under continuous compression. Further, if desired, a suitable resinous, ceramic, or other bonding material 147 such as braze alloy or the like may be provided for anchoring the strips 146 in position.

A wide variety of further modifications and improvements of the invention are believed possible without varying from the scope of the invention. Accordingly, the embodiments presented herein are not intended to limit the invention, except by way of the appended claims.

What is claimed is:

1. A heat exchanger construction comprising a plurality of plates connected in stacked relation and formed to define layered fluid flow paths for passage of first and second fluids in heat exchange relation with each other, said connected plates having peripheral edges forming a plurality of peripheral recesses; and elongated thermal mass means received within said peripheral recesses for protecting said peripheral edges against stress failure.

2. A heat exchanger construction as set forth in claim 1 wherein said plates comprise a plurality of substantially identical plates each having a generally planar central portion bounded by a generally trough-shaped peripheral edge terminating in an outwardly extending peripheral lip formed generally coplanar with said central portion, said plates being connected together in inverted pairs with said trough-shaped edges in abutting back-to-back relation whereby each connected pair of said plates defines a fluid flow region for passage of the first fluid; and including means for connecting said connected pairs of said plates in a stacked relation and for defining a fluid flow region between the connected plate pairs for passage of the second fluid.

3. A heat exchanger construction as set forth in claim 2 including extended surface elements received within the flow regions for passage of the first fluid for increasing heat transfer surface area therein.

4. A heat exchanger construction as set forth in claim 3 wherein said extended surface elements each comprise a relatively thin element of generally corrugated configuration forming a plurality of relatively small flow passages for the first fluid.

5. A heat exchanger construction as set forth in claim 2 wherein said connecting means comprises extended surface elements connected between the connected plate pairs for increasing the heat transfer surface area there between.

6. A heat exchanger construction as set forth in claim 5 wherein said extended surface elements each comprise a relatively thin element of generally corrugated configuration forming a plurality of relatively small flow passages for the second fluid.

7. A heat exchanger construction as set forth in claim 2 including manifold means for manifolding the first and second fluids for passage through their respective flow regions.

8. A heat exchanger construction as set forth in claim 2 wherein said peripheral edges and lips of each connected pair of plates combine to form one of said peripheral recesses, said recess being peripherally outwardly presented for receiving said thermal mass means.

9. A heat exchanger construction as set forth in claim 1 wherein said thermal mass means is formed to have preselected thermal and mass properties for absorbing and retaining heat energy for controlling thermal gradients at the peripheral edges of said plates for protecting said edges against stress failure.

10. A heat exchanger construction as set forth in claims 1 and 9 wherein said thermal mass means is mounted within said peripheral recesses for controllably prestressing said plates.

11. A heat exchanger construction as set forth in claim 10 wherein said thermal mass means is mounted within said peripheral recesses for controllably placing said plates under peripherally inward compression.

12. A heat exchanger construction as set forth in claim 2 wherein said trough-shaped peripheral plate edges form said peripheral recesses.

13. A heat exchanger construction as set forth in claim 2 wherein said thermal mass means is received within peripheral recesses formed by said trough-shaped edges, and within peripheral recesses formed by the peripheral edges and lips of each connected pair of plates.

14. A heat exchanger construction as set forth in claim 1 wherein said thermal mass means comprises a plurality of elongated strips having preselected thermal and mass properties.

15. A heat exchanger construction as set forth in claim 14 including a bonding material for securing said strips within said recesses.

16. A heat exchanger construction as set forth in claim 1 wherein said thermal mass means is formed from a material having a coefficient of thermal expansion lower than that of said plates.

17. A heat exchanger construction as set forth in claim 1 wherein said thermal mass means is formed from a material which is relatively creep-resistant compared to said plates.

18. A heat exchanger construction as set forth in claim 1 wherein said thermal mass means is formed from a material having a coefficient of thermal expansion different from that of said plates, said thermal mass means being secured within said recesses to prevent relative movement between said thermal mass means and said plates.

19. A heat exchanger construction comprising a plurality of plates each having a generally planar central portion bounded by a generally trough-shaped peripheral edge; means for connecting said plates in inverted pairs with said trough-shaped edges in abutting back-to-back relation to form a fluid flow region between each connected pair of plates for passage of a first fluid; means for arranging said connected pairs of plates in stacked relation and forming a fluid flow region between adjacent connected pairs of plates for passage of a second fluid; and thermal mass means embedded within said trough-shaped edges for protecting said edges against stress failure.

20. A heat exchanger construction as set forth in claim 18 wherein said thermal mass means is mounted within said edges for controllably placing said plates under peripheral compression.

21. A heat exchanger construction comprising a plurality of plates each having a generally planar central portion bounded by a generally trough-shaped peripheral edge terminating in an outwardly extending peripheral lip; means for connecting said plates in inverted pairs with said trough-shaped edges in abutting back-to-back relation to form a fluid flow region between each connected pair of plates for passage of a first fluid, said peripheral edges and said lips of each connected pair of plates combining to define an outwardly presented peripheral recess; means for arranging said connected pairs of plates in stacked relation and forming a fluid flow region between adjacent pairs of connected plates for passage of a second fluid; and thermal mass means embedded within each outwardly presented peripheral recess for protecting said edges against stress failure.

22. A heat exchanger construction as set forth in claim 21 wherein said thermal mass means is mounted within said recesses for controllably placing said plates under peripheral compression.

23. A heat exchanger construction comprising a plurality of plates connected together in pairs and formed to define a first plurality of fluid flow paths for passage of a first fluid, each connected pair of plates including at least one peripheral recess; means forming a second plurality of fluid flow paths for passage of a second fluid, said means and said connected pairs of plates being connected in an alternating stack for passage of said first and second fluids in heat exchange relation with each other; and thermal mass means received within said peripheral recesses for protecting said peripheral edges against stress failure.

24. A heat exchanger construction as set forth in claim 23 wherein said thermal mass means is mounted within said recesses for controllably placing said plates under peripheral compression.

25. A heat exchanger construction comprising a plurality of plates connected in stacked relation and formed to define layered fluid flow paths for passage of two fluids in heat exchange relation with each other, said connected plates having peripheral edges forming a plurality of peripheral recesses; and elongated thermal mass means formed from a material having a coefficient of thermal expansion less than that of said plates, and received within said peripheral recesses for protecting said peripheral edges against stress failure.

* * * * *